United States Patent [19]

Kallmeyer et al.

[11] 4,147,822

[45] Apr. 3, 1979

[54] COMPOSITE STRUCTURE AND PROCESS AND APPARATUS FOR MAKING THE SAME

[75] Inventors: Albert W. Kallmeyer, Crestwood; Harry A. Holman, Jr., Ladue, both of Mo.

[73] Assignee: McDonnell Douglas Corporation, St. Louis, Mo.

[21] Appl. No.: 699,473

[22] Filed: Jun. 24, 1976

[51] Int. Cl.[2] ..... B32B 5/12; B32B 3/28; B05D 3/02; D03D 3/02

[52] U.S. Cl. ..... 428/35; 139/16; 139/387 R; 427/390 R; 428/167; 428/213; 428/114

[58] Field of Search ..... 427/390 R; 139/16, 387 R; 428/35, 167, 213, 114

[56] References Cited

U.S. PATENT DOCUMENTS

| | | | |
|---|---|---|---|
| 3,719,212 | 3/1973 | Emerson et al. | 139/387 R |
| 3,750,714 | 8/1973 | Holman et al. | 139/16 |
| 3,875,973 | 4/1975 | Kallmeyer et al. | 139/16 |

*Primary Examiner*—William R. Dixon, Jr.
*Attorney, Agent, or Firm*—Gravely, Lieder & Woodruff

[57] ABSTRACT

A composite structure containing a weave and a rigidifying resin matrix is formed in a hollow configuration with inwardly directed ring stiffeners. This is achieved by arranging longitudinal strands in radial rows or groups around a base mandrel and weaving a circumferential strand through the longitudinal strands. When a wall section of normal width is desired, a submandrel is placed around the base mandrel and those longitudinal strands located innermost in their respective groups are passed behind the submandrel so that the circumferential strand is woven only through the longitudinal strands located outwardly from the submandrel. Where a ring stiffener is desired, the thickness of the weave is increased by weaving the circumferential strand through all of the longitudinal strands located beyond the base mandrel, and this of course takes place beyond the end of the submandrel. Longitudinal stiffeners may be provided along with the ring stiffeners by forming depressions in the submandrels. This enables all of the longitudinal strands at the depression to remain outwardly from the exterior surface of the submandrel so the circumferential strand may be woven through them at that location.

12 Claims, 9 Drawing Figures

COMPOSITE STRUCTURE AND PROCESS AND APPARATUS FOR MAKING THE SAME

BACKGROUND OF THE INVENTION

This invention relates in general to composite structures and more particularly to woven composite structures having integrally formed stiffeners as well as to a process and apparatus for making the composite structure.

Composite structures composed of weaves impregnated with suitable resins are particularly useful in the aerospace industry due to their light weight, high strength and ability to withstand high temperatures. The typical composite structure consists of a three-dimensional weave, that is a weave having substantial thickness, and a thermo-setting resin matrix in which the woven strands are embedded. In the usual procedure, suitable yarns are woven together to form the three-dimensional weave, and then the weave is immersed in liquid resin. The resin impregnates the weave. Thereafter the resin is heated to cure it and the cured resin forms a very rigid matrix which holds the woven yarns in place. U.S. Pat. Nos. 3,750,714 and 3,875,973 disclose machines for forming three-dimensional weaves of circular cross-section.

In spite of their high strength, composite structures of the type stated have not been widely used in purely structural capacities, primarily due to the difficulty of providing integrally formed stiffeners in such composites. These stiffeners take the form of ribs and of course substantially increase the strength of the overall composite structure without appreciably increasing the weight. Because of this problem composite materials have, to a large measure, been confined to merely protective uses. For example, the noses of high performance re-entry missiles have a beryllium structural assembly of generally conical shape and a heat shield of composite material extended over the outer surface of the beryllium structure. The beryllium on its inwardly presented surface is machined out to provide ring stiffeners and even possibly longitudinal stiffeners. Beryllium, however, is an extremely expensive metal, and is not easily machined. Furthermore, it is quite toxic when reduced to a dust as occurs during machining.

SUMMARY OF THE INVENTION

One of the principal objects of the present invention is to provide a composite structure having integrally formed rib stiffeners. Another object is to provide a composite structure of the type stated which may be used in place of the combination of a composite skin attached to a metal structural member. A further object is to provide a composite structure of the type stated which is easily and inexpensively produced, and does not require a large amount of expensive machining operations. An additional object is to provide a composite structure of the type stated which is ideally suited for use as the noses of high performance re-entry missiles. Still another object is to provide a process and an apparatus for making the composite structure of the type stated. These and other objects and advantages will become apparent hereinafter.

The present invention is embodied in a composite structure having an impregnated weave, some of the strands of which are severed and interrupted so as to create thickened portions in the weave. The invention is also embodied in the process by which the composite structure is formed and the apparatus on which the composite structure is formed. The invention also consists in the parts and in the arrangements and combinations of parts hereinafter described and claimed.

DESCRIPTION OF THE DRAWINGS

In the accompanying drawings which form part of the Specification and wherein like numerals and letters refer to like parts wherever they occur.

DETAILED DESCRIPTION

Figure 1:
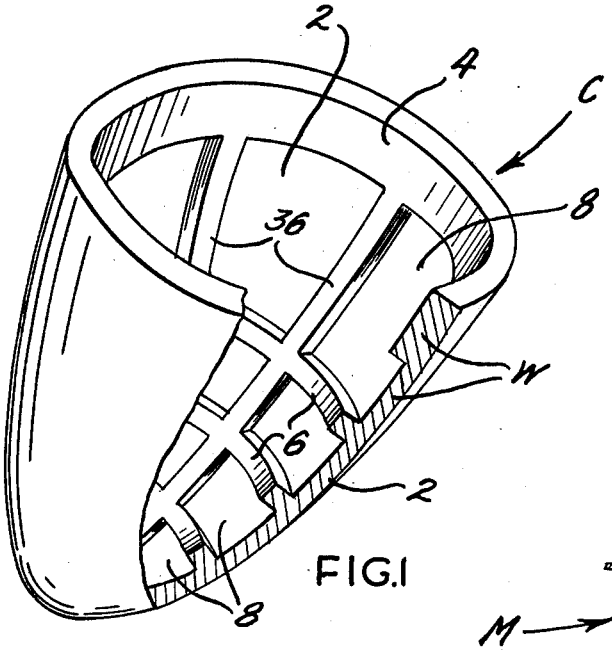
FIG. 1 is a perspective view, partially broken away and in section, of a typical composite structure constructed in accordance with and embodying the present invention.

Referring now to the drawings (FIG. 1), C designates a composite structure which in this case is a nose cone for a re-entry missile, but it may have shapes suitable for many other structural applications. The composite structure C is hollow and for the most part is composed of a tapered wall 2 having a uniform thickness. The wall 2 is of circular cross-section and is closed at one end and open at its other, possessing a somewhat conical configuration between the two ends. The large diameter end of the wall 2 merges into a connecting section 4 which is somewhat thicker than the wall 2. The connecting section 4, while being of circular cross-section, is nevertheless configured to connect to some other structure such as the main body of a re-entry missile. The exterior surfaces of the wall 2 and connecting section 6 are continuous and flush, the increase thickness of the connecting section 4 being projected inwardly in the form of a ring. The wall 2 has ring stiffeners 6 formed integrally with it, and those stiffeners are likewise projected inwardly. They are spaced axially from one another as well as from the connecting section 4 and create inwardly opening cavities or voids 8 in the structure C.

Figure 2:
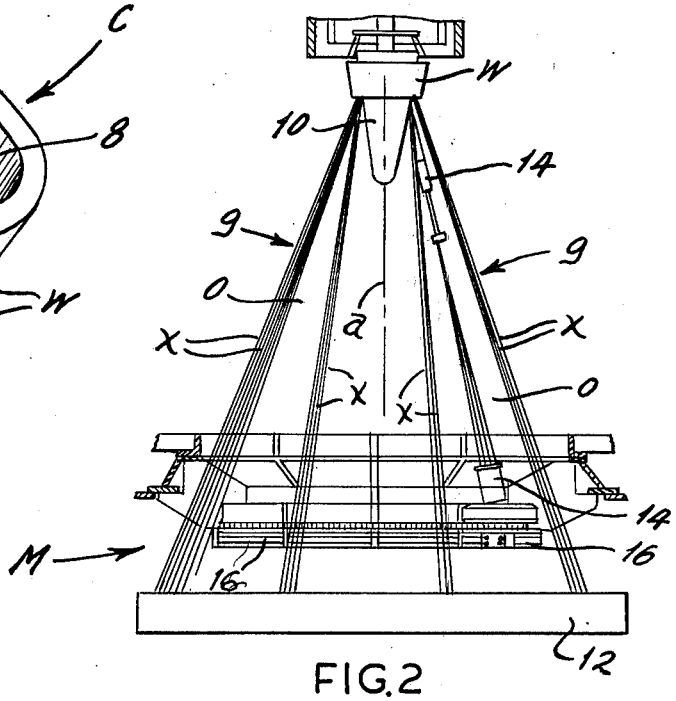
FIG. 2 is an elevational view of the weaving machine which produces the weave.

The composite structure C for the most part is composed of a weave W which is formed on a circular weaving machine M (FIG. 2) from suitable yarns or strands which may be graphite, silica, carbon, or fibered glass, to name a few. The weave W includes (FIG. 4) longitudinal strands or yarns X and a circumferential strand or yarn Y which is woven through the longitudinal yarns X. The circumferential yarn Y forms convolutions which extend crosswise with respect to the longitudinal yarns X and hence may be referred to as cross-strands or cross-yarns Y. The weave W is formed about a tapered base mandrel 10 which is supported on the weaving machine M. The longitudinal yarns X extend along the tapered side surface of the base mandrel 10 and are arranged in groups g, with the groups g being spaced at equal circumferential intervals around the mandrel 10. Each group g contains a plurality of closely spaced longitudinal yarns X arranged one after the other in a row extended away from the side surface of base mandrel 10. In other words, the longitudinal yarns X of each group g are located along a single radius emanating from the axis a of the mandrel 10.

Figure 4:
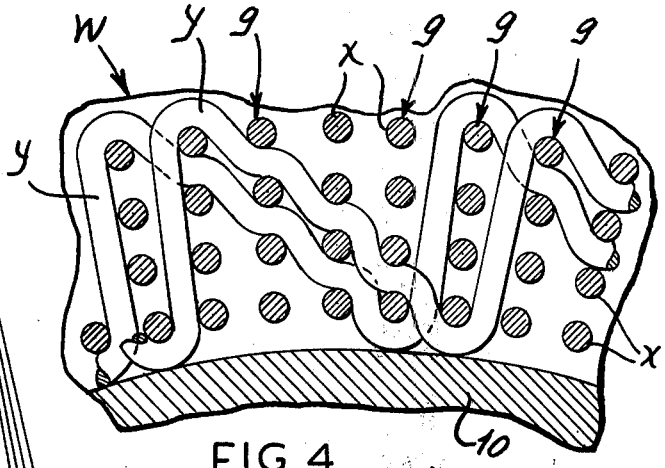
FIG. 4 is a fragmentary sectional view taken along line 4—4 of FIG. 3.

The weaving machine M has a shedding mechanism 12 (FIG. 2) which creates a shed opening O in the groups g of closely spaced longitudinal yarns X, and this is achieved by moving all of the longitudinal yarns X beyond the location of the opening O outwardly. The same close spacing is maintained between the adjacent yarns X of the group g, except at the shed opening O where the spacing between the two adjacent yarns X is substantially greater than the relatively small gaps between the remaining yarns X. The circumferential yarn Y is laid into the shed openings O by a thread inserting device 14 on the machine M. This device follows a circular track 16, which is concentric to the axis a of the base mandrel 10, and as it does the circumferential yarn Y pays out of it and into the shed openings O of successive groups g of longitudinal yarns X. The position of the shed opening O in each group g of longitudinal yarns X normally changes with each revolution of the thread inserting device 14 so that within any group g successive convolutions of the circumferential yarn Y will be located between different pairs of longitudinal yarns X (FIG. 4). U.S. Pat. No. 3,750,714 discloses a circular weaving machine capable of supporting the mandrel 10 with the longitudinal yarns X arranged in the groups g around it, and having a shed mechanism for creating the shed openings O and also a filament insertion device for laying the circumferential yarn Y into the shed openings O. U.S. Pat. No. 3,875,973 discloses a similar weaving machine with an improved shed mechanism.

The number of longitudinal yarns X in the groups g is enough to form a weave equal in thickness to the thickest portion of the composite structure. This is normally at the connecting section 4 and the ring stiffeners 6.

Figure 3:
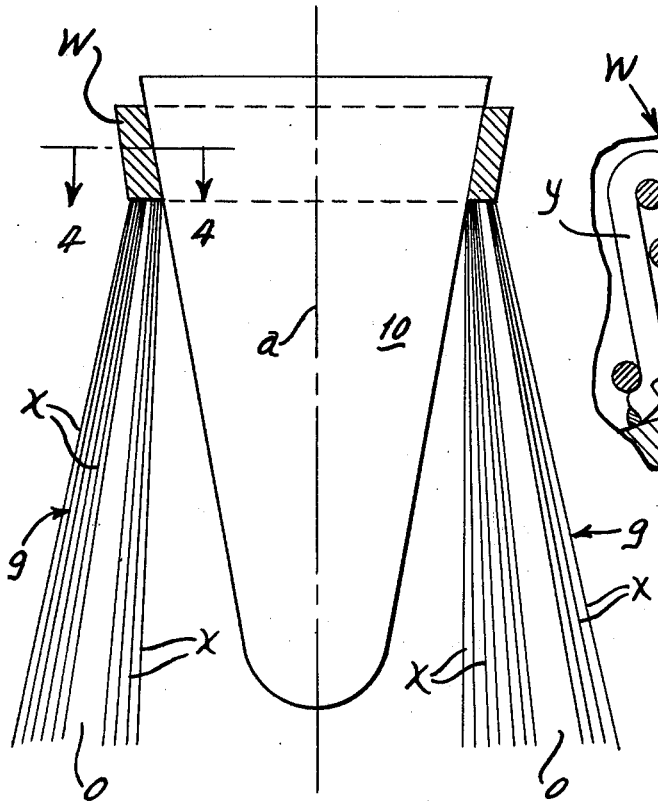
FIG. 3 is an enlarged sectional view in the elevation showing the weave as it is initially formed to create the thick connecting portion in the overall weave.

The weave W is commenced at the connecting section 4 and builds up in the axial direction as successive convolutions of the circumferential yarn Y are laid into the shed openings O which are continuously changing position (FIG. 3). Indeed, the changes in position of the shed opening O for any group g with each successive convolution may move from the base mandrel 10 outwardly, then inwardly toward the mandrel 10, and then outwardly again, etc., so that longitudinal yarn Y occupies the full depth of the weave W at the connecting section 6.

Figure 8:
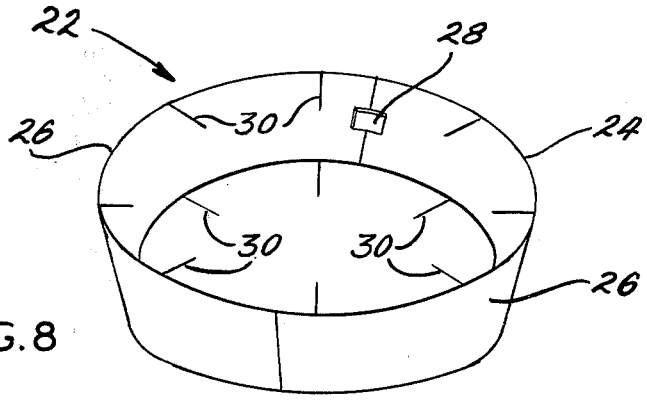
FIG. 8 is a perspective view of a typical submandrel.

When enough convolutions of the circumferential yarn Y have been laid in place to complete the connecting section 4, the weaving machine M is stopped and the shed mechanism 12 is activated to provide a shed opening O at the same location in all of the groups g. The location of that shed opening O is such that the number longitudinal yarns X positioned outwardly from it are sufficient to provide the desired thickness of the wall 2 when the circumferential yarn Y is woven into it. However, before the weaving is resumed a secondary or submandrel 22 (FIGS. 5 and 8) is placed around the base mandrel 10 at the end of the completed portion of the weave W, that is next to the weave for the connecting section 4.

The submandrel 22 includes a ring 24 having a tapered exterior surface in the shape of a frustrum of a cone. The taper of this surface corresponds to that of the side surface on the base mandrel 10 at the location where submandrel 22 encircles it. The ring 24 is segmented so that it can be broken down into actuate segments 26 (FIG. 8), each of which occupies an arc of about 180°. Each segment 26 at its end is provided with a connector 28 for joining it to the adjacent segment 26.

Figure 5:
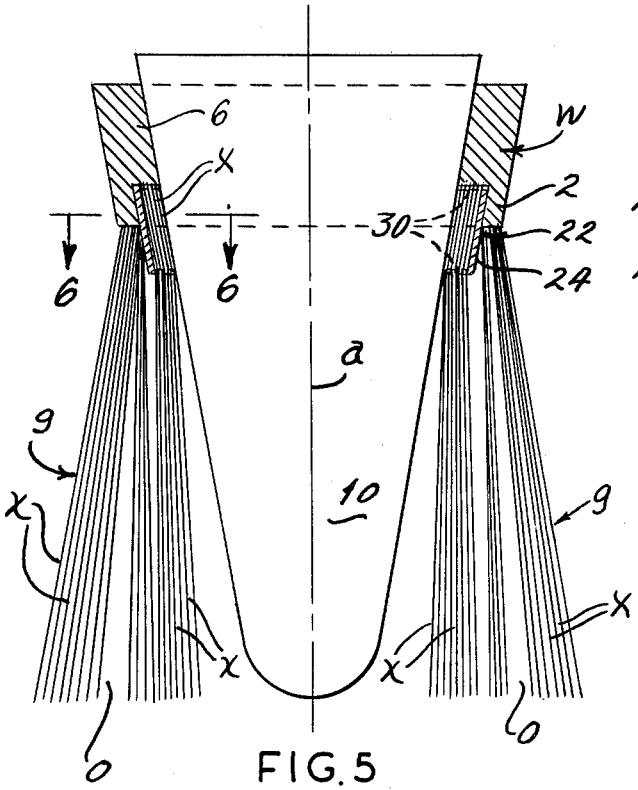
FIG. 5 is an elevational view showing the weave being formed over a submandrel to produce a wall section of reduced thickness in the overall weave.

The submandrel 22 further includes spacer elements 30 (FIGS. 5 and 8) which project inwardly from the interior surface of the ring 24. These spacer elements 30 are positioned at equal circumferential intervals and are quite narrow in the circumferential direction. Moreover, they are of equal length, and that length is such when the ring 24 is brought up to and against the completed weave W of the connecting section 6, the inner ends of the spacer elements 26 will bear against the side face of the base mandrel 10 and maintain the ring 24 concentric about the mandrel 10. The diameter of the ring 24 is such that it will fit into the shed opening O formed about the base mandrel 10 at the completion of the weave for the connecting section 4 (FIG. 5). The length or axial dimension of the ring 24 equals the length of that portion of the wall 2 located between the connecting section 4 and the first ring stiffener 6 of the completed composite structure C.

Figure 6:
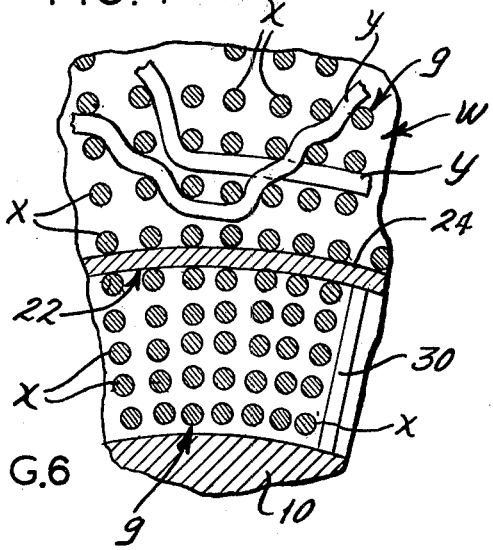
FIG. 6 is a sectional view taken along line 6—6 of FIG. 5.

The submandrel 22 is installed around the base mandrel 10 such that it encircles the longitudinal yarns X located inwardly from the shed openings O and is in turn surrounded by the longitudinal yarns X located outwardly from the shed opening O. In other words, the spacer elements 30 position the ring 24 within the shed openings O, and due to their narrow width provide sufficient clearance in the circumferential direction to enable the longitudinal yarns X which are located inwardly from the shed openings O to pass between the ring 24 and the tapered side surface of the base mandrel 10. Once the mandrel 22 is emplaced, the inserting device 14 of the weaving machine M is again energized to continue the weave. However, the subsequent shed openings O are formed only in those longitudinal yarns X which are located outwardly from the ring 24. As a result the weave W builds up on the outside of the ring 24 (FIGS. 5 and 6). Again for any group g of longitudinal yarns X, the location of the shed openings O may move outwardly and inwardly and then outwardly again with each successive convolution of circumferential yarn Y, so that the convolutions of the circumferential yarn Y occupy the entire width of the weave W outwardly from the submandrel 22. Thus the longitudinal yarns X to the outside of the ring 24 have the circumferential yarn Y woven through them, but this is not true of the longitudinal yarns X on the inside of the ring 24.

Figure 7:
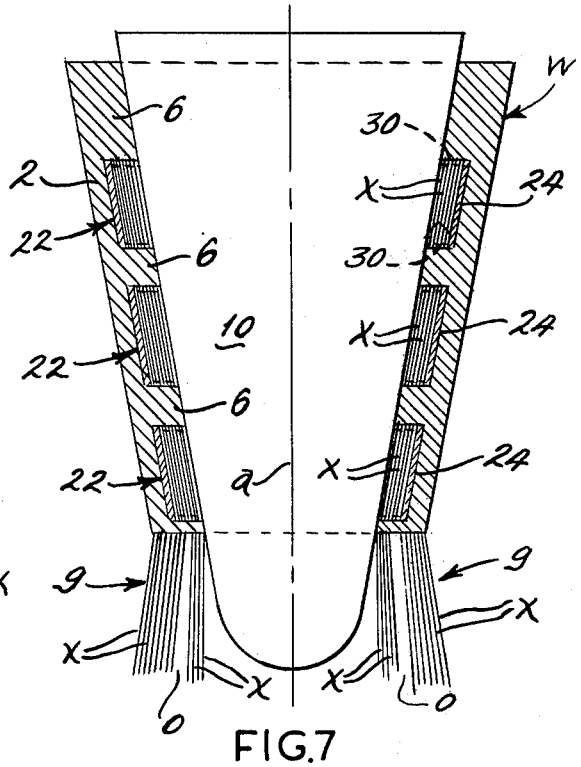
FIG. 7 is a sectional view showing a plurality of thickened sections and several submandrels dispersed amongst them with wall sections of reduced thickness being located outwardly from the submandrels.

At the end of the submandrel 22 the shed openings O are again formed throughout the entire width of the various groups g of longitudinal yarns X so that the convolutions of the circumferential yarn Y occupy the entire width of each group g of longitudinal yarns X (FIG. 7). Consequently, the weave W at this location acquires a greater width. Indeed, the weave W extends all the way inwardly to the outer surface of the base mandrel 10. This portion of the weave W constitutes the first ring stiffener 6.

When sufficient convolutions of circumferential yarn Y have been laid into the groups g of longitudinal yarn X to provide a thickened portion equal in length to the first ring stiffener 6, the weaving is again temporarily stopped and a shed opening O is created in each group g of longitudinal yarns X. The number of longitudinal yarns X located outwardly for these shed openings O is sufficient to provide the weave W with a thickness equal to that of the tapered wall 2. Another submandrel 22 (FIG. 7) is installed in these shed openings O and brought against the end of that much of the weave W which has been completed. This submandrel 22 is identical in every respect to the previous submandrel 22, except that it is slightly smaller in diameter to accommodate the lesser diameter of the base mandrel 10 at that point. The weave W is built up over the ring 24 of the second submandrel 22 in the same manner as it was built up over the ring 24 of first submandrel 22, thus providing a weave of sufficient thickness for a continuation of the tapered wall 2.

At the end of the second submandrel 22, the weave W is again continued for the full width of the groups g of longitudinal yarns X so as to provide a weave of sufficient thickness for the second ring stiffener 6 (FIG. 7). The weave W is continued with alternating thin and thick portions until the entire mandrel 10 is covered, or at least enough of it to equal the length of the composite structure C. The thin portions of course require additional submandrels 22 which are identical to the other submandrels 22 except for size.

Once the weave W is completed, those portions of the longitudinal yarns X which extend beyond the weave W are cut off and the base mandrel 10 is removed from the weaving machine M. The submandrels 22 and the weave W remain around the base mandrel 10. Then the weave W is impregnated with a rigidifying substance. To this end the base mandrel 10, along with the submandrels 22 and the weave W, are immersed in a suitable liquid resin. Epoxy or phenolic resins are suitable for this purpose. The base mandrel 10 is left in the resin long enough to enable the resin to impregnate the weave W. Then, the base mandrel 10 is removed from the resin, and the resin impregnating the weave W is partially cured. The cure is sufficiently long to impart rigidity or stiffness to the weave W.

After the partial cure, the base mandrel 10 is withdrawn from the weave W, but the weave W does not collapse since the partially cured resin enables the weave W to maintain the same shape. Next those longitudinal yarns X which extend through the submandrels 22, that is inside the ring 24 of those submandrels, are severed where they emerge from the thicker woven portions which are the ring stiffeners 6. This frees the submandrels 22 which are removed by pulling their arcuate segments 26 inwardly to free them of ring stiffeners 6 and then withdrawing those individual segments axially through the interior of the impregnated weave W. The places formerly occupied by the submandrels 22 constitute the voids 8 in the composite structure C.

After all of the submandrels 4 have been removed from the impregnated weave W, the weave W is again immersed in the liquid resin to achieve further impregnation. Thereupon, the weave W is removed and the resin is heated to achieve a final cure. The result is the light weight, yet rigid and extremely tough composite structure C.

Finally the composite structure C which is so formed may be machined at various surfaces thereon so as to provide a precise configuration. Normally the connecting section 4 is machined to enable it to be joined to another structure such as the body of a re-entry missile. The machining is preferably done with a diamond wheel.

Figure 9:
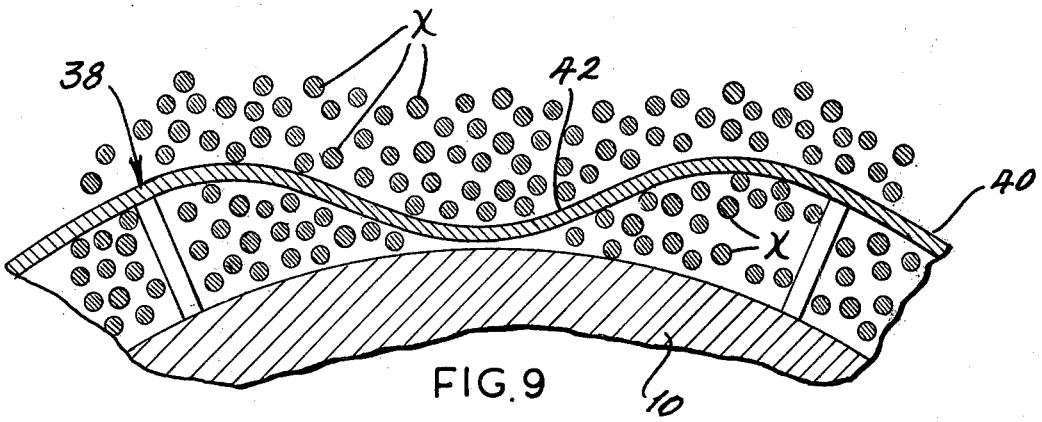
FIG. 9 is a fragmentary transverse sectional view of a submandrel having a depression therein for producing longitudinal stiffeners.

In addition to the ring stiffeners 6, the composite structure C may also be provided with longitudinal stiffeners 36 (FIG. 1). These are obtained by using slightly different submandrels 38 (FIG. 9) having rings 40 provided with depressions 42 at the locations where the longitudinal stiffeners 36 are desired. Normally the depressions 42 of successive rings 40 align in the axial direction, and each depression 42 extends inwardly to about the exterior surface of the base mandrel 10. Moreover, the sides of the depressions 42 do not turn abruptly inwardly, but are flared instead so that they approach tangency with the surface of the base mandrel 10. Few, if any, longitudinal strands at a depression 42 pass behind the ring 38. As a result, the circumferential yarn Y is woven through all of the yarns X in those groups g located opposite the depressions 42. The flared sides of the depressions 42 enable the circumferential yarn Y to extend inwardly to the side of the base mandrel 10. The weave in the depressions 42 merges with the weaves in the thickened portions at each end of the submandrel 38 in which the depression 42 exists. The length of the longitudinal stiffeners 36 depends on the number of submandrels 38 which are located about the base mandrel 10, that is the number of submandrels having depressions 42 therein. For example, if all of the submandrels have depressions 42 which are furthermore in alignment, the longitudinal stiffener 36 will extend almost the entire length of the composite structure C.

Once the composite structure C is freed of its base mandrel 10 and submandrels 38, the longitudinal stiffeners 36 may be machined to provide them with a rectilinear or squared off configuration. In this regard, the stiffeners 36 will initially have a flared configuration, owing to the flare of the sides of the depressions 42 in which they are formed.

While the composite structure C heretofore described has been a nose cone for re-entry missiles, stiffened structures of other hollow configurations and suitable for other purposes may likewise be produced. For example the process may be used to produce jet engine parts, air foil shapes, radomes, and aircraft landing gear struts, to name a few.

While the process is particularly useful in forming composite structures of hollow configurations, it may also be used on contour weaving machines capable of producing purely orthagonal weaves. Such a weaving machine is disclosed in U.S. patent application Ser. No. 666,241 of H. Holman, A. Kallmeyer, H. Paulsen, and W. Weaver, filed Mar. 12, 1976, and entitled LOOM FOR PRODUCING THREE DIMENSIONAL WEAVES, now U.S. Pat. No. 4,019,540. In that case, the weaving would occur along a base mandrel, but not around it as in the case of a circular weave. Submandrels would be placed against the base mandrel where cavities are desired in the weave, and this would of course result in a thinner weave at those areas.

This invention is intended to cover all changes and modifications of the example of the invention herein chosen for purposes of the disclosure which do not constitute departures from the spirit and scope of the invention.

What is claimed is:

1. A composite structure comprising: a plurality of longitudinal strands arranged one after the other in two directions so as to provide an array having depth, some of the longitudinal strands being interrupted so as to form a void in the array; a cross strand woven through the interrupted as well as the uninterrupted longitudinal strands, whereby the weave so formed possess greater thickness where the interrupted strands exist; and a resin matrix rigidifying the weave.

2. A composite structure according to claim 1 wherein the weave closes upon itself so as to have a hollow interior.

3. A composite structure according to claim 2 wherein the voids open inwardly.

4. A composite structure according to claim 3 wherein several voids exist, one after the other in the direction of the longitudinal strands, and the portions of the weave located at the interrupted strands form ring stiffeners in the composite structure.

5. A composite structure according to claim 3 wherein at least one location in the array the longitudinal strands are uninterrupted so as to pass by the void and the cross strand is woven through these uninterrupted longitudinal strands so as to form a longitudinal rib in the weave.

6. A ribbed composite structure comprising: a plurality of longitudinal strands arranged side-by-side in two directions so as to provide an array that has both depth and width, some of the longitudinal strands being cut intermediate their ends such that sections are removed therefrom, leaving spaced apart sections in the array, the longitudinal strands which are cut being grouped together so as to provide a void in the array of longitudinal strands, there being at least some uncut longitudinal strands to the back of the void so that the void does not open out of more than one face of the array; cross strands extended crosswise with respect to the longitudinal strands and being woven through the uncut longitudinal strands as well as through the cut sections which remain in the array, whereby a weave is produced; and a rigid matrix impregnating the weave so as to rigidify the weave.

7. A composite structure according to claim 6 wherein the weave closes upon itself in a tubular configuration and the longitudinal strands extend in the direction of the axis of the tubular configuration.

8. A composite structure according to claim 7 wherein the void opens inwardly, and the portion of the weave at the cut sections of the longitudinal strands which remain in the weave form an inwardly projecting rib.

9. A process for producing a composite structure, said process comprising:

(1) positioning longitudinal strands along a base mandrel such that the strands are built up on each other with some strands being closer to the base mandrel than others;
(2) forming a weave along the base mandrel by weaving cross stands through the longitudinal strands;
(3) installing a submandrel along the base mandrel such that some of the longitudinal strands pass in back of the submandrel and others pass in front of the submandrel;
(4) forming more weave along the submandrel by weaving cross strands through only the longitudinal strands located in front of the submandrel;
(5) impregnating the weave with a rigidifying substance while the weave is still along the base mandrel and submandrel;
(6) separating the weave from the base mandrel;
(7) severing the longitudinal strands located behind the submandrel; and
(8) thereafter removing the submandrel from the weave.

10. A process according to claim 9 wherein the longitudinal strands are arranged around the base mandrel and the cross strand is passed around the base mandrel and the submandrel as it is woven through the longitudinal strands so as to form successive convolutions about the base mandrel and submandrel.

11. The process according to claim 9 wherein the longitudinal strands are arranged in groups with the strands of each group being arranged generally in a row extending away from the base mandrel; and wherein the step of forming the weave further comprises forming shed openings in the groups of longitudinal strands and passing the cross strand through the shed openings.

12. A process for producing a composite structure, said process comprising:

(1) positioning longitudinal strands such that the strands are in groups that are disposed around a base mandrel and the strands of each group form a row of strands which extends away from the base mandrel;
(2) forming a weave around the base mandrel by creating shed openings in the groups of longitudinal strands and passing a cross strand around the base mandrel and through the shed openings so as to form successive convolutions of cross strands about the base mandrel;
(3) installing a submandrel along the base mandrel such that some of the longitudinal strands pass in back of the submandrel and others pass in front of the submandrels;
(4) forming more weave around the submandrel by creating shed openings in the groups of longitudinal strands located in front of the submandrel and passing a cross strand through the shed openings so formed so as to form successive convolutions of cross strands about the submandrel;
(5) impregnating the weave with a rigidifying substance while the weave is still around the base mandrel and submandrel;
(6) thereafter causing the rigidifying substance to harden and rigidify the weave;
(7) removing the base mandrel from the weave;
(8) severing the longitudinal strands located behind the submandrel; and
(9) thereafter removing the submandrel from the weave.

* * * * *